US007585528B2

(12) United States Patent
Ferri et al.

(10) Patent No.: US 7,585,528 B2
(45) Date of Patent: Sep. 8, 2009

(54) PACKAGE HAVING AN INFLATED FRAME

(75) Inventors: Isabella Ferri, San Lazzaro di Savena (IT); Riccardo Palumbo, Arona (IT); Stefano Santagostino, Milan (IT); Andrea Granili, Lainate (IT); Carmen Roveda, Nerviano (IT)

(73) Assignee: Cryovac, Inc., Duncan, SC (US)

( * ) Notice: Subject to any disclaimer, the term of this patent is extended or adjusted under 35 U.S.C. 154(b) by 516 days.

(21) Appl. No.: 10/500,908

(22) PCT Filed: Dec. 16, 2002

(86) PCT No.: PCT/EP02/14338

§ 371 (c)(1),
(2), (4) Date: Feb. 10, 2005

(87) PCT Pub. No.: WO03/051740

PCT Pub. Date: Jun. 26, 2003

(65) Prior Publication Data

US 2005/0126941 A1 Jun. 16, 2005

(30) Foreign Application Priority Data

Dec. 19, 2001 (EP) ..... 01830780

(51) Int. Cl.
*B65D 81/03* (2006.01)

(52) U.S. Cl. ..... 426/110; 426/112; 426/122; 426/123; 426/129; 426/316; 426/410; 206/522; 383/3; 383/119

(58) Field of Classification Search ..... 426/129, 426/106, 110, 112, 119–120, 122–123, 312, 426/316, 392, 410, 413, 414; 206/522; 383/3, 383/119

See application file for complete search history.

(56) References Cited

U.S. PATENT DOCUMENTS

| | | | | | |
|---|---|---|---|---|---|
| 3,089,153 | A | * | 5/1963 | Bosc | 5/710 |
| 3,191,849 | A | | 6/1965 | Gutowski et al. | |
| 3,771,247 | A | * | 11/1973 | De Harak | 40/736 |
| 3,784,086 | A | * | 1/1974 | Forbes, Jr. | 383/106 |
| 3,873,735 | A | * | 3/1975 | Chalin et al. | 426/87 |
| 4,155,453 | A | | 5/1979 | Ono | |
| 4,164,970 | A | * | 8/1979 | Jordan | 383/3 |
| 4,240,556 | A | | 12/1980 | Field | |
| 4,278,198 | A | * | 7/1981 | Norton et al. | 383/119 |
| 4,872,558 | A | | 10/1989 | Pharo | |
| 4,918,904 | A | | 4/1990 | Pharo | |
| 5,061,501 | A | * | 10/1991 | Lowe | 426/124 |
| 5,137,154 | A | * | 8/1992 | Cohen | 206/522 |

(Continued)

FOREIGN PATENT DOCUMENTS

EP 0 987 103 B1 3/2000

(Continued)

*Primary Examiner*—Drew E Becker
(74) *Attorney, Agent, or Firm*—Daniel B. Ruble

(57) ABSTRACT

A package for containing a product such as meat. The package includes top and bottom opposing flexible chamber sheets. These sheets are sealed together in a selected chamber seal zone to define a watertight chamber portion that is capable of containing the product. A hollow frame circumscribes the chamber portion. The frame supports the chamber portion when the frame is inflated. The need for a rigid tray may be eliminated by the inventive package.

36 Claims, 12 Drawing Sheets

U.S. PATENT DOCUMENTS

| | | | | | |
|---|---|---|---|---|---|
| 5,211,875 | A | | 5/1993 | Speer et al. | |
| 5,260,023 | A | * | 11/1993 | Evans, II | 422/40 |
| 5,272,856 | A | * | 12/1993 | Pharo | 53/472 |
| 5,348,157 | A | | 9/1994 | Pozzo | |
| 5,350,622 | A | | 9/1994 | Speer et al. | |
| 5,447,235 | A | | 9/1995 | Pharo | |
| 5,454,642 | A | | 10/1995 | De Luca | |
| 5,487,470 | A | | 1/1996 | Pharo | |
| 5,582,853 | A | * | 12/1996 | Marnocha et al. | 426/122 |
| 5,588,532 | A | | 12/1996 | Pharo | |
| 5,588,533 | A | | 12/1996 | Farison et al. | |
| 5,617,662 | A | * | 4/1997 | Hwang | 40/736 |
| 5,620,096 | A | | 4/1997 | Pozzo | |
| 5,692,833 | A | * | 12/1997 | DeLuca | 383/3 |
| 5,711,691 | A | | 1/1998 | Damask et al. | |
| 5,791,485 | A | * | 8/1998 | Carbonneau | 206/720 |
| 5,862,914 | A | | 1/1999 | Farison et al. | |
| 5,950,833 | A | * | 9/1999 | James | 206/522 |
| 6,076,677 | A | | 6/2000 | Pozzo | |
| 6,213,669 | B1 | * | 4/2001 | Yamamoto | 402/73 |
| 6,276,532 | B1 | | 8/2001 | Sperry et al. | |
| 6,299,984 | B1 | | 10/2001 | Forloni | |
| 6,398,029 | B1 | | 6/2002 | Farison et al. | |
| 6,520,332 | B1 | | 2/2003 | Barmore et al. | |
| 6,629,777 | B2 | * | 10/2003 | Tanaka et al. | 383/3 |
| 2005/0263426 | A1 | * | 12/2005 | Ho | 206/522 |
| 2007/0003170 | A1 | * | 1/2007 | Yoshida | 383/3 |
| 2008/0035519 | A1 | * | 2/2008 | Swartz et al. | 206/522 |

FOREIGN PATENT DOCUMENTS

| | | |
|---|---|---|
| FR | 1371316 | 9/1964 |
| FR | 2769594 | 4/1999 |
| WO | 01/68363 A1 | 9/2001 |

* cited by examiner

PACKAGE HAVING AN INFLATED FRAME

BACKGROUND OF THE INVENTION

The present invention relates to packaging having a chamber portion for containing a product and an inflated frame surrounding the chamber, and to methods of making such packaging.

It is common in food packaging operations for a food product (e.g., fresh meat) to be placed on a rigid tray (e.g., a thermoformed expanded polystyrene tray having a central depressed area and a surrounding peripheral flange). A thermoplastic film may then be positioned over the food and heat sealed to the peripheral flange to hermetically enclose the food product.

However, a high percentage of the final packaging costs for such packaging systems is due to the relatively high cost of such trays. Further, there are costs and inconveniences associated with transporting and storing the trays before their use in the packages. Also, such trays add to the volume of packaging waste material with which the consumer must deal after opening the package.

SUMMARY OF THE INVENTION

The present invention addresses one or more of the aforementioned problems.

A package for containing a product includes top and bottom opposing flexible chamber sheets. These sheets are sealed together in a selected chamber seal zone to define a watertight chamber portion that is capable of containing the product. A hollow frame circumscribes the chamber portion. The frame supports the chamber portion when the frame is inflated.

A process of packaging includes the following steps: 1) providing a base web comprising a flexible sheet material; 2) placing a product on the base web; 3) positioning over the product a lid web comprising a flexible sheet material; 4) sealing the lid web to the base web at a selected chamber seal zone to form a chamber portion enclosing the product; and 5) sealing the lid web to the base web at one or more selected frame seal zones to form a hollow frame circumscribing the chamber portion and adapted to support the chamber portion when the frame is inflated.

The need for a rigid tray may be eliminated by the inventive package, so that the package may be considered "tray-less."

These and other objects, advantages, and features of the invention will be more readily understood and appreciated by reference to the detailed description of the invention and the drawings.

DETAILED DESCRIPTION OF THE INVENTION

Figure 1:
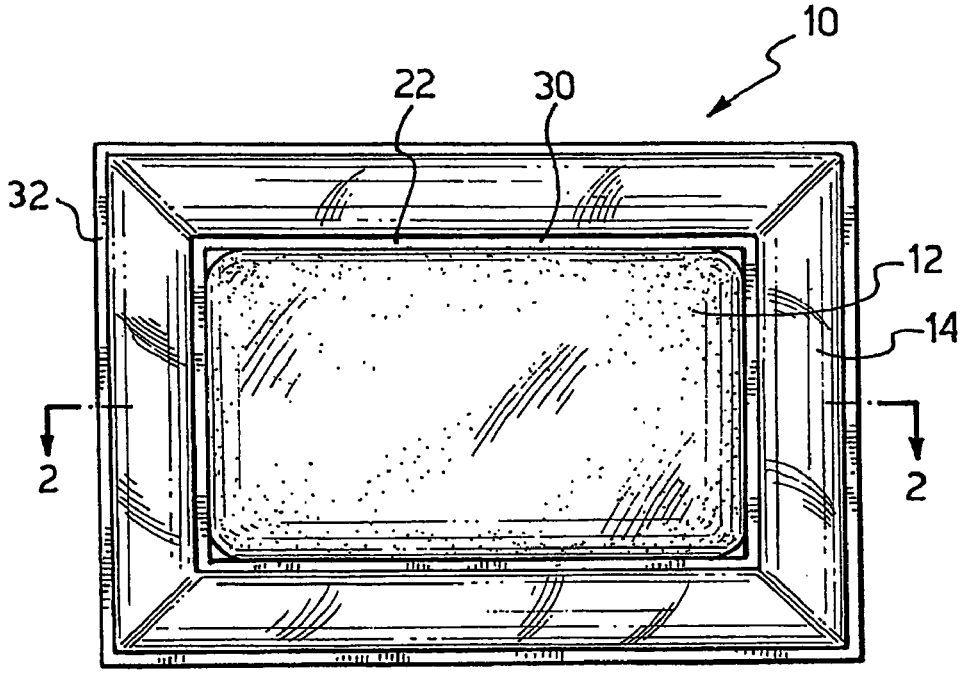
FIG. 1 is a plan view of a package of the present invention having the frame in an inflated state and a modified atmosphere in the chamber portion.
Figure 2:
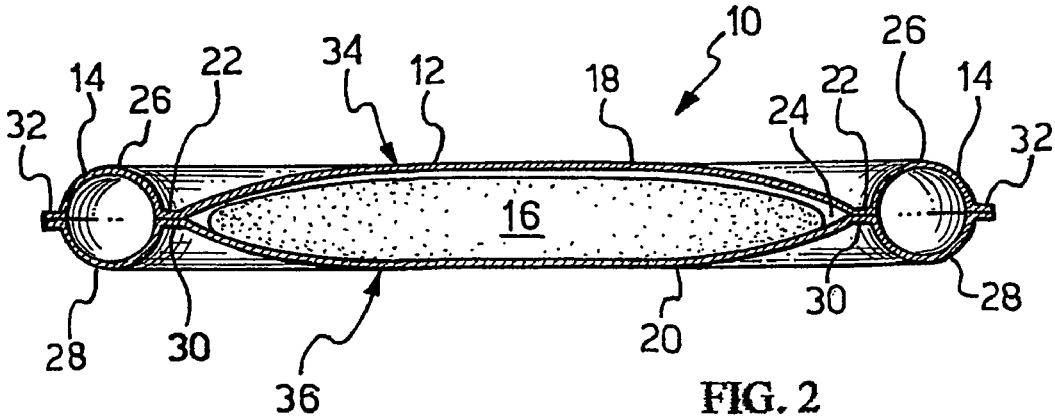
FIG. 2 is a sectional view taken along line 2-2 of FIG. 1.

With reference to FIG. 1 and the sectional view of the same package at FIG. 2, package 10 comprises a chamber portion 12 circumscribed by a hollow frame 14. The chamber portion 12 may be, and preferably is, "watertight" (i.e., does not permit leakage or permeation of liquid water except if subjected to structural discontinuity) and further it may be, and preferably is, "airtight" or "hermetic" (i.e., does not permit permeation of oxygen at a rate above 1000 cubic centimeters (at standard temperature and pressure) per square meter per day per 1 atmosphere of oxygen pressure differential measured at 0% relative humidity and 23° C., unless subjected to structural discontinuity). Chamber portion 12 is capable of or adapted to contain product 16. The chamber portion 12 may include a top chamber sheet 18 and a bottom chamber sheet 20, which may be juxtaposed and sealed together at a chamber seal zone 22 to form the chamber portion 12. The terminology "top" and "bottom" sheets as used in this application includes the sense of one sheet of material folded over upon itself to form the top and bottom sheets.

Hollow frame 14, which is shown in an inflated state, circumscribes chamber portion 12. The frame 14 is adapted to support the chamber portion 12 when the frame 14 is inflated. Frame 14 may be inflated with any fluid material, such as liquids, flowable powders or, preferably, with gases.

Figure 3:
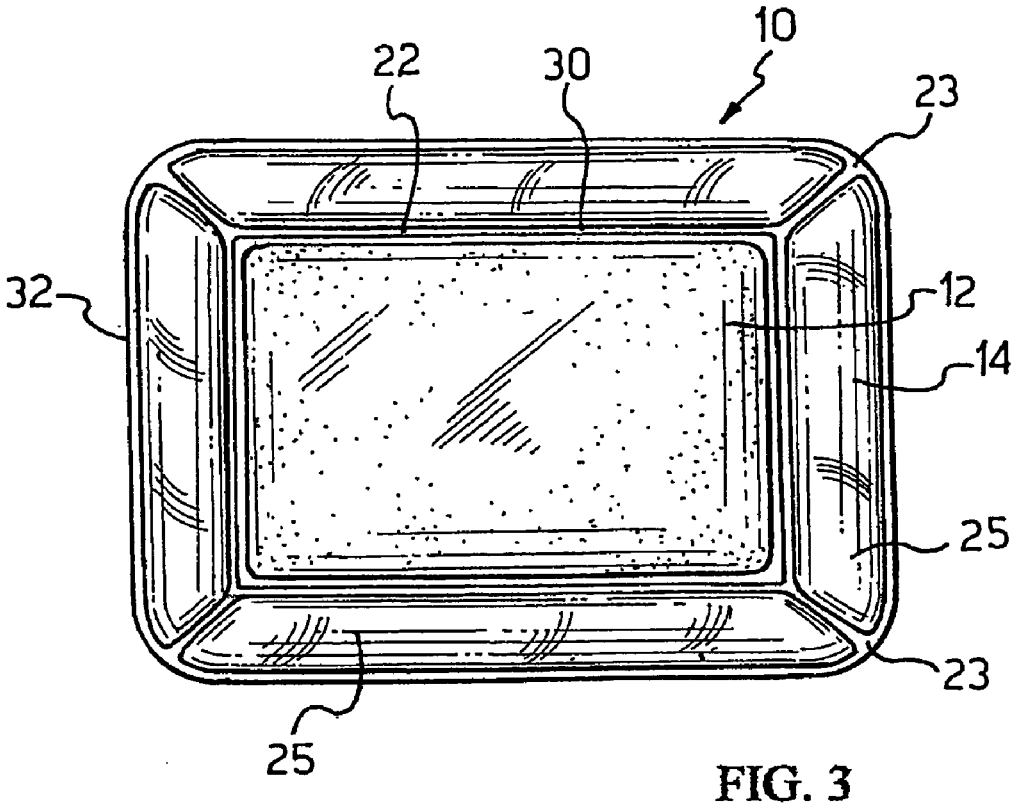
FIG. 3 is a plan view of one embodiment of the package of the present invention wherein the frame in interrupted by seals.

Frame 14 may be in form of a continuous tube surrounding chamber portion 12, as shown in FIG. 1, or said continuous tube may be interrupted by one or more seals 23, as illustrated in FIG. 3.

When frame 14 is interrupted by more than one seal, said seals create two or more discrete frame chambers 25. The advantage of having discrete chambers clearly resides in the possibility that one chamber of the frame may deflate without deflating the entire frame. Preferably in this embodiment the seals interrupting the frame are two or more and are disposed symmetrically along the frame in order to avoid or prevent as much as possible any distortion of the end package. Preferably, in case of packages of substantially rectangular or square shape, as illustrated in FIG. 3, said seals are positioned in the corners.

Figure 4:
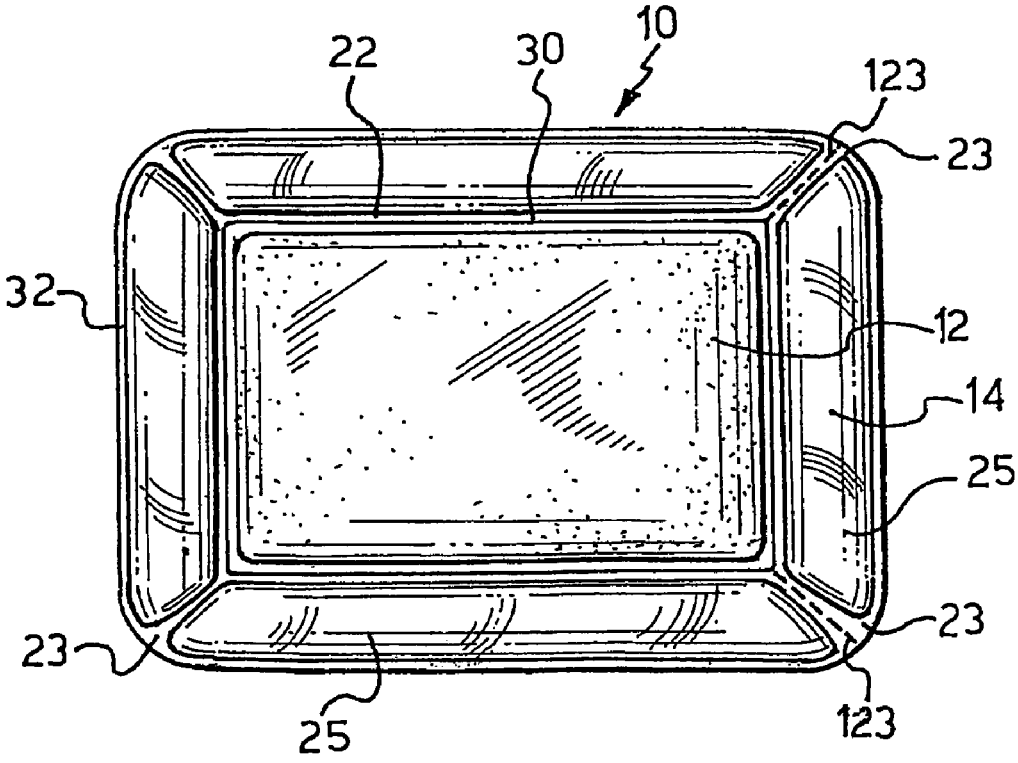
FIG. 4 is a plan view of another embodiment of the package of the present invention.

In a further embodiment, illustrated in FIG. 4, said one or more seals 23 may contain continuous or discontinuous (serrated) cuts 123. The advantage of this embodiment resides in the possibility for the end user to easily open the package by grasping by hands the two edges of the frame that are separated by cut-seals 123 and tearing them apart, thus using the cut-seal as a notch. This can be done with or without prior deflation of the frame, in case of a single cut-seal, or of the two discrete chambers 25 of the frame that are adjacent to the cut-seal used as the package notch.

Frame 14 may include a top frame sheet 26 and a bottom frame sheet 28, which may be juxtaposed and sealed together at a frame inner seal zone 30 and a frame outer seal zone 32 to form frame 14.

Figure 5:
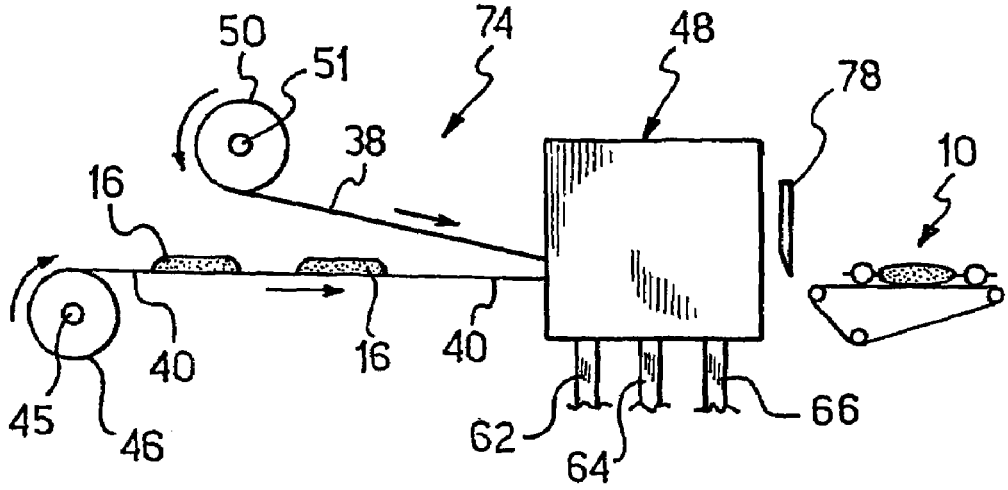
FIG. 5 is a representative schematic of a process line for making a package of the present invention.

As illustrated in FIG. 2, lid sheet 34 extends continuously from the frame to the chamber portion, thereby including both top chamber sheet 18 and top frame sheet 26. Also as illustrated in FIG. 2, base sheet 36 extends continuously from the frame to the chamber portion, thereby including both bottom chamber sheet 20 and bottom frame sheet 28. The lid sheet 34 may be formed from a lid web 38 (FIG. 5) and the base sheet 36 may be formed from a base web 40 (FIG. 5). As used herein, a "web" is a continuous length of sheet material handled in roll form, as contrasted with the same material cut into short lengths.

In order to support chamber portion 12 when frame 14 is inflated, frame 14 may be attached to the exterior perimeter of chamber portion 12, for example, by one or more heat or adhesive seals, or by a tape (not shown) or other mechanical linkage attaching frame 14 to the chamber portion 12. For example, as illustrated in FIG. 2, frame 14 is attached to the chamber portion 12 by virtue of lid sheet 34 and base sheet 36, which extend continuously from frame 14 to chamber portion 12 to attach frame 14 to chamber portion 12. Either or both of the lid and base sheets may extend continuously from the frame to the chamber portion to attach the frame 14 to the chamber portion 12.

Frame inner seal zone 30 may be coextensive with chamber portion seal zone 22, as illustrated in FIGS. 1-2. Alternatively, the frame inner seal zone 30 may be spaced apart from chamber portion seal zone 22 or may be adjacent to chamber portion seal zone 22. If lid sheet 34 is sealed to base sheet 36 so that frame inner seal zone 30 is coextensive with chamber portion seal zone 22, then the frame 14 and chamber portion 12 may share a common seal, as illustrated in FIG. 2. In such case, the frame inner seal zone 30 may be said to include or comprise chamber portion seal zone 22—or chamber portion seal zone 22 may be said to include or comprise frame inner seal zone 30.

The sheets (i.e., top and bottom chamber sheets, top and bottom frame sheets, lid and base sheets) may be sealed together at any of the seal zones (e.g., chamber seal zone 22, the frame inner seal zone 30, and the frame outer seal zone 32) by any method, such as heat sealing (e.g., conductance sealing, impulse sealing, ultrasonic sealing, dielectric sealing) or by application of a suitable adhesive (e.g., a UV-curable adhesive) (not shown) between the sheets in the applicable seal zone. Such methods and the relative equipment are well known to those of skill in the art.

Figure 6:
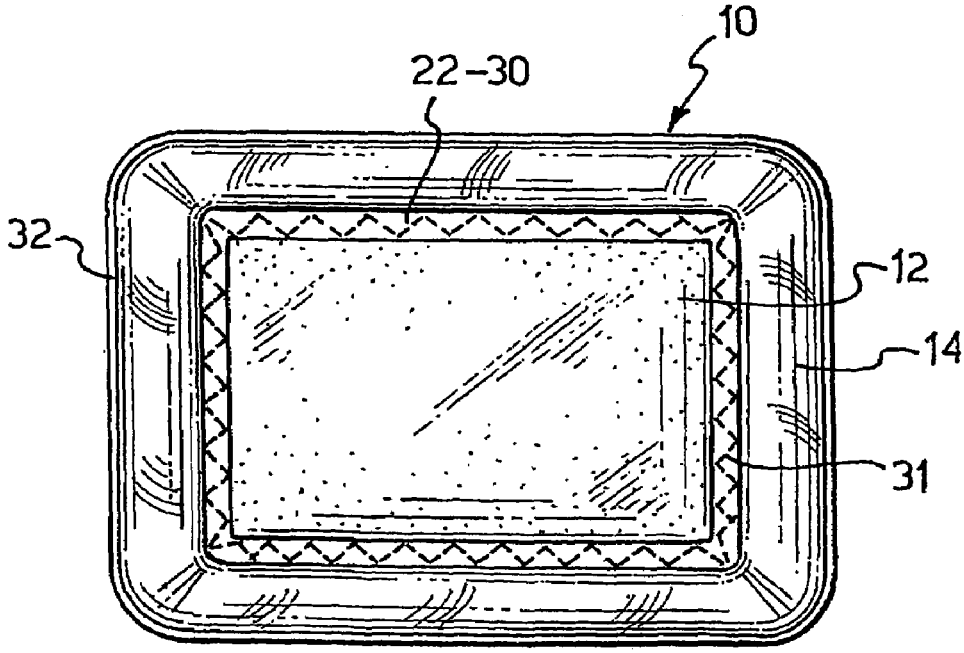
FIG. 6 is a plan view of a further embodiment of the package of the present invention wherein the chamber portion containing the packaged product can be detached from the outer frame.

As illustrated in FIG. 6, it is also possible to create a line of weakness 31, embedded in the coextensive seal that separates chamber portion 12 from hollow frame 14, or positioned between the chamber portion seal zone 22 and the frame inner seal zone 30, in case these two zones are spaced apart. The presence of such a weakness line may allow detachability of chamber portion 12 containing the packaged product 16 from the inflated frame 14 if and when desired. This possibility might be particularly useful e.g. when it is necessary for the customer to reduce the size of the package to better store it at home. In FIG. 6 the weakness line 31 is shown as a zig-zag serration embedded in a wide coextensive seal 22-30 separating chamber portion 12 from frame 14. By breaking the serration it is thus possible to separate the sealed chamber portion 12 containing product 16 from the circumscribing frame portion 14. In this embodiment, once the chamber portion is separated, it is also possible, if desired, to use the shaped edges of the zig-zag serration as a tear initiator to easy open the package.

Figure 7:
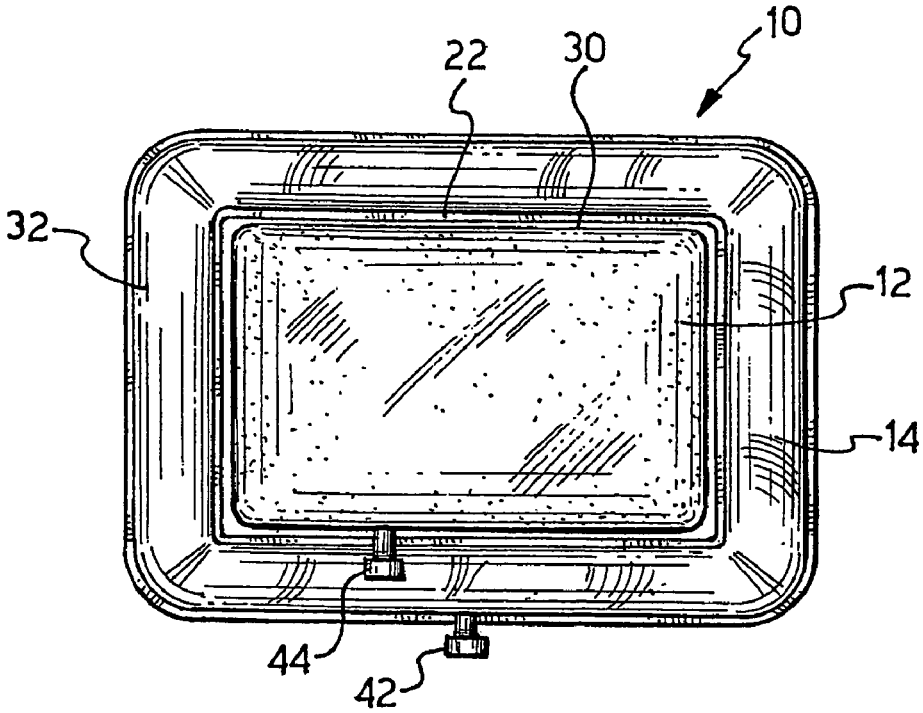
FIG. 7 is a plan view of a package of the present invention having a frame inflation passageway and a chamber inflation passageway.

As illustrated in another embodiment shown in FIG. 7, package 10 includes a frame inflation passageway 42 attached to frame 14 to provide access to the interior of hollow frame 14 for inflating the frame. Accordingly, frame inflation passageway 42 may be connected to one or more portions of frame 14 and be in fluid communication with the interior space of frame 14. A chamber inflation passageway 44 may be attached to chamber portion 12 to provide access to the interior space of chamber portion 12 for introducing a modified atmosphere into the interior space of chamber portion 12. Chamber inflation passageway 44 may be connected to one or more portions of chamber portion 12 and be in fluid communication with the interior space of chamber portion 12. Examples of frame inflation passageway 42 and chamber inflation passageway 44 include sealable inflation passageways or one-way inflation valves, for example, as illustrated in U.S. Pat. No. 6,276,532 by Sperry et al, which is incorporated herein in its entirety by reference.

Figure 8:
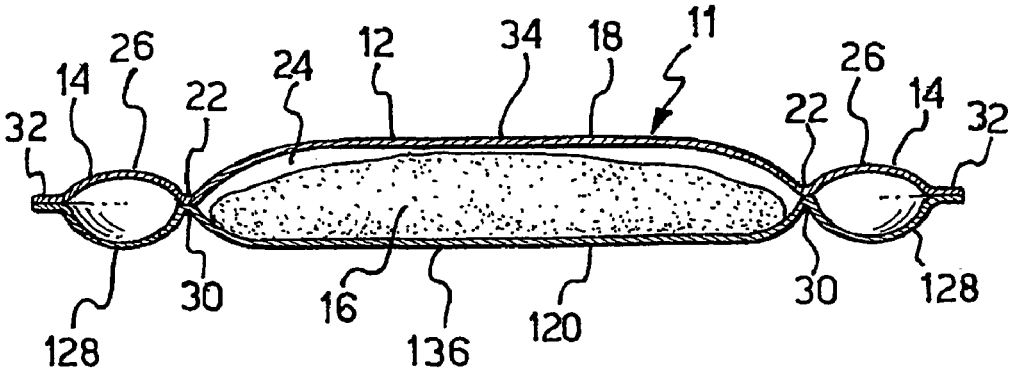
FIG. 8 is a representative sectional view of a package of the present invention having a thermoformed base sheet.

As illustrated in another preferred embodiment shown in FIG. 8, package 11 includes a thermoformed bottom chamber sheet 120 and a thermoformed bottom frame sheet 128, which may be provided as thermoformed base sheet 136. The thermoformed bottom chamber sheet 120 may provide a configuration adapted for convenient placement of, or conformance to, product 16 within chamber portion 12.

Figure 9:
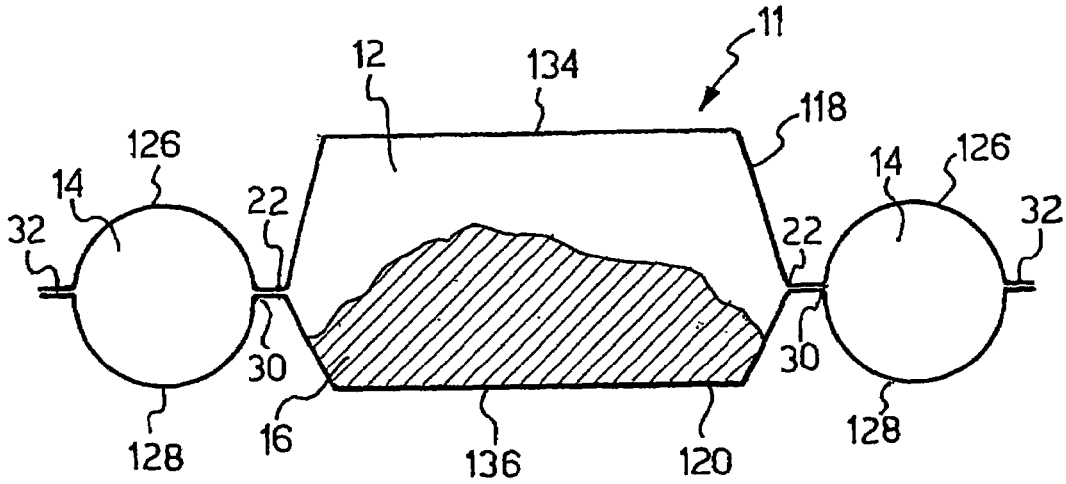
FIG. 9 is a representative sectional view of a package of the present invention having a thermoformed base sheet and a thermoformed lid sheet.

As illustrated in still another preferred embodiment shown in FIG. 9, package 11 may include a thermoformed bottom chamber sheet 120 and a thermoformed bottom frame sheet 128, which may be provided as thermoformed base sheet 136, as well as a matching thermoformed top chamber sheet 118 and a thermoformed top frame sheet 126, which may be provided as thermoformed lid sheet 134.

The package of the present invention may be useful for the packaging of food as well as non-food products.

When a product 16 is packaged which is preferably stored under an atmosphere different from ambient air, package 10 (11) may conveniently include a modified atmosphere 24 in chamber portion 12, so that product 16 may be packaged in said modified atmosphere 24. A modified atmosphere may be useful, for example, to decrease the concentration of oxygen from that of ambient air or to increase the concentration of oxygen and carbon dioxide from that of ambient air in order to extend a packaged product's shelf-life or bloom color life. For example, in packaging meat, the atmosphere in the sealed package may comprise about 80% by volume oxygen and about 20% by volume carbon dioxide in order to inhibit the growth of harmful microorganisms and extend the time period in which the meat retains its attractive red ("bloom") coloration. As used herein, the term "modified atmosphere" refers to a gas environment having a composition that is altered from that of ambient air for the purpose of extending the shelf life, enhancing the appearance, or reducing the degradation of a packaged product.

Examples of modified atmosphere 24 include gas environments having an oxygen concentration (by volume): 1) greater than about any of the following values: 30%, 40%, 50%, 60%, 70%, 80%, and 90%, 2) ranging between any of the preceding values (e.g., from about 30% to about 90%), 3) no more than about any of the following values: 15%, 10%, 5%, 1%, and 0%, and 4) ranging between any of the preceding values (e.g., from about 0% to about 15%). A modified atmosphere may also include gas environment having a carbon dioxide concentration of greater than about any of the following values: 10%, 20%, 30%, 40%, and 50% by volume. The modified atmosphere 24 may also include non-ambient amounts of one or more gases selected from e.g. argon, nitrogen, carbon monoxide, helium, and the like gases.

When a modified atmosphere 24 is employed, the package according to the present invention is particularly useful for the packaging of oxygen-sensitive items (i.e., items that are perishable, degradable, or otherwise changeable in the presence of oxygen). Examples of oxygen-sensitive products or items include red meat (e.g., beef, veal, and lamb), processed meat, pork, poultry, fish, cheese, and vegetables. Package 10 (11) may also include an absorbent pad (not shown) within chamber portion 12, for example, to absorb meat purge and/or release moisture or fragrances.

As used herein, "the sheets" refers to any of the top and bottom chamber sheets 18 (118), 20 (120), top and bottom frame sheets 26 (126), 28 (128), and lid and base sheets 34 (134), 36 (136). Any of the sheets may comprise one or more layers of thermoplastic polymer materials such as for instance polyolefins, polystyrenes, polyurethanes, polyamides, polyesters, polyvinyl chlorides, ionomers and blends thereof.

Useful polyolefins include ethylene homo- and co-polymers and propylene homo- and co-polymers. Ethylene homopolymers include high density polyethylene ("HDPE"), a polyethylene with a density higher than 0.94 g/cm$^3$, typically comprised between 0.94 and 0.96 g/cm$^3$, medium density polyethylene ("MDPE"), a polyethylene with density typically comprised between 0.93 and 0.94 g/cm$^3$, and low density polyethylene ("LDPE") a polyethylene with density below 0.93 g/cm$^3$. Ethylene copolymers include ethylene/alpha-olefin copolymers ("EAOs") and ethylene/unsaturated ester copolymers ("copolymer" as used in this application means a polymer derived from two or more types of monomers, and includes terpolymers, etc.)

EAOs are copolymers of ethylene and one or more alpha-olefins, the copolymer having ethylene as the majority mole-percentage content. The comonomer may include one or more $C_3$-$C_{20}$ $\alpha$-olefins, such as one or more $C_4$-$C_{12}$ $\alpha$-olefins, preferably one or more $C_4$-$C_8$ $\alpha$-olefins. Useful $\alpha$-olefins include 1-butene, 1-hexene, 5-methyl-1-pentene, 1-octene, and mixtures thereof.

EAOs include one or more of the following: linear medium density polyethylene ("LMDPE"), for example having a density of from 0.926 to 0.94 g/cm$^3$, linear low density polyethylene ("LLDPE"), for example having a density of from 0.915 to 0.930 g/cm$^3$, and very-low or ultra-low density polyethylene ("VLDPE" and "ULDPE"), for example having density below 0.915 g/cm$^3$. Unless otherwise indicated, all densities herein are measured according to ASTM D1505.

The polyethylene polymers and copolymers may be either heterogeneous or homogeneous. As is known in the art, heterogeneous polymers have a relatively wide variation in molecular weight and composition distribution; whereas, homogeneous polymers have a relatively narrow variation in molecular weight and composition distribution. Heterogeneous polymers may be prepared with, for example, conventional Ziegler Natta catalysts. On the other hand, homogeneous polymers are typically prepared using metallocene or other single site-type catalysts.

Another useful ethylene copolymer is ethylene/unsaturated ester copolymer, which is the copolymer of ethylene and one or more unsaturated ester monomers. Useful unsaturated esters include vinyl esters of aliphatic carboxylic acids, containing from 4 to 12 carbon atoms (e.g., vinyl acetate), and alkyl esters of acrylic or methacrylic acid (collectively, "alkyl (meth)acrylate"), containing from 4 to 12 carbon atoms.

Useful propylene copolymer includes propylene/ethylene copolymers ("EPC"), which are copolymers of propylene and ethylene having a majority weight % content of propylene, such as those having an ethylene comonomer content of less than 10%, preferably less than 6%, and more preferably from about 2% to 6% by weight; and propylene-ethylene-butene terpolymers (or propylene-ethylene-higher a-olefin terpolymers) having a majority wt. % of propylene, such as those having a total amount of ethylene and butene (or ethylene and higher $\alpha$-olefin) of less than 25 wt. %, preferably less than 20 wt. %. Also the propylene polymers can be heterogeneous or homogeneous.

Suitable polyamides are both homo-polyamides or co- (ter- or multi-)polyamides, which can be aliphatic, aromatic or partially aromatic. The homopolyamides are derived from the polymerisation of a single type of monomer comprising both the chemical functions which are typical of polyamides, i.e. amino and acid groups, such monomers being typically lactams of amino-acids, or from the polycondensation of two types of polyfunctional monomers, i.e. polyamines with polybasic acids. The co-, ter-, and multi-polyamides on the other hand are derived from the copolymerisation of precursor monomers of at least two (three or more) different polyamides, e.g. two different lactams, or two types of polyamines and/or polyacids, or a lactam on the one side and a polyamide and a polyacid on the other. Examples of suitable polyamides are PA 6, PA 6/66, PA 6/12, PA 6I/6T, PA MXD6, PA MXD6/MXDI, and the like polyamides.

Examples of useful polyesters include amorphous (co) polyesters, comprising an aromatic dicarboxylic acid, e.g. terephthalic acid, naphthalenedicarboxylic acid, and isophthalic acid, as the main dicarboxylic acid component and an aliphatic glycol, e.g., ethylene glycol, trimethylene glycol, tetramethylene glycol, optionally admixed with an alicyclic glycol, such as cyclohexane dimethanol, as the main glycol component. Polyesters with at least about 75 mole percent, more preferably at least about 80 mole percent, based on the total of the dicarboxylic acid component, of terephthalic acid may be preferred.

As reported above, any of the sheets may be mono- or multi-layered. If a sheet is multilayered, then the sheet may include one or more outer layers of a heat-sealable material to assist in heat sealing the sheets together, as is known in the art. Such a sealant layer may include one or more of the thermoplastic polymers discussed above.

It may be advantageous for any, or one or more, of the sheets to have gas (e.g., oxygen, carbon dioxide) barrier attributes to decrease the gas permeability of the sheet. Barrier attributes for the sheets may be useful, for example to increase the inflated life of frame 14, to enhance the storage life of a packaged product 16 contained within chamber portion 12 that may degrade upon exposure to oxygen (e.g., red meat), and to help maintain a modified atmosphere 24 that may be contained within chamber portion 12.

Any, or one or more, of the sheets may therefore comprise one or more materials ("barrier components") that markedly decrease the oxygen or carbon dioxide transmission rate through the sheet and thus impart barrier attributes to the sheet. (Since carbon dioxide barrier properties generally correlate with oxygen barrier properties, only oxygen barrier properties are discussed in detail herein.) Examples of barrier components include: ethylene/vinyl alcohol copolymer ("EVOH"), polyvinyl alcohol ("PVOH"), vinylidene chloride polymers ("PVdC"), polyalkylene carbonate, polyester (e.g., PET, PEN), polyacrylonitrile ("PAN"), and polyamide. Preferred barrier materials are EVOH, PVDC, polyamides and blends of EVOH and polyamides.

EVOH may have an ethylene content of between about 20% and 40%, preferably between about 25% and 35%, more preferably about 32% by weight. EVOH may include saponified or hydrolyzed ethylene/vinyl acetate copolymers, such as those having a degree of hydrolysis of at least 50%, preferably of at least 85%.

Vinylidene chloride polymer ("PVdC") refers to a vinylidene chloride-containing copolymer, that is, a polymer that includes monomer units derived from vinylidene chloride ($CH_2{=}CCl_2$) and monomer units derived from one or more of vinyl chloride, styrene, vinyl acetate, acrylonitrile, and $C_1$-$C_{12}$ alkyl esters of (meth)acrylic acid (e.g., methyl acrylate, butyl acrylate, methyl methacrylate). As is known in the art, one or more thermal stabilizers, plasticizers and lubricating processing aids may be used in conjunction with PVdC.

If a sheet is multilayered, then the one or more layers of the sheet that incorporate barrier components in an amount sufficient to notably decrease the oxygen permeability of the sheet are considered "barrier layers." If the sheet is monolayered, then the barrier components may be incorporated in the sole layer of the sheet and the sheet itself may be considered a "barrier layer."

A useful barrier layer includes that having a thickness and composition sufficient to impart to the sheet incorporating the barrier layer an oxygen transmission rate of no more than about any of the following values: 150, 100, 50, 45, 40, 35, 30, 25, 20, 15, 10, and 5 cubic centimeters (at standard temperature and pressure) per square meter per day per 1 atmosphere of oxygen pressure differential measured at 0% relative humidity and 23° C. All references to oxygen transmission rate in this application are measured at these conditions according to ASTM D-3985. For example, top and bottom chamber sheets 18 (118), 20 (120) as well as top and bottom frame sheets 26 (126), and 28 (128), may each have a thickness and composition sufficient to impart to each of the sheets any of the oxygen transmission rates previously recited.

When the modified atmosphere 24 in chamber portion 12 is free from oxygen and the packaged product 16 is particularly oxygen-sensitive, it may also be advisable to include an oxygen scavenging agent in the top and/or in the bottom chamber sheets 18 (118), 20 (120), in a layer in closer proximity to the packaged product than the gas-barrier layer. The oxygen scavenging agent present in said layer will react with the residual oxygen that is trapped in the package or that permeates into the package in spite of the gas barrier layer, thus maintaining the modified atmosphere 24 free from oxygen. The use of oxygen scavengers is described for instance in U.S. Pat. No. 5,350,622 while a general method of triggering the oxygen scavenging process is described in U.S. Pat. No. 5,211,875. The content of both these documents in its enterity is incorporated herein by reference.

The sheets may have any thickness suitable for the packaging application, preferably taking into consideration factors such as the desired inflation pressure of the frame and/or chamber portion, the tensile strength of the sheet material, the hoop stress resulting from the given inflated configuration of the frame and/or chamber portion, the amount of abuse expected for the application, whether the sheets are thermoformed or not and the desired gas permeation rate through the sheets. Useful sheet thickness ranges include from about 0.5 to about 10 mils, preferably from about 1 to about 9 mils, and more preferably from about 2 to about 8 mils.

Any or all of the sheets may have one or more of the characteristics selected from flexible, stretchable, extendable, and elastic. For example, a sheet may be stretched by inflation. The sheets preferably exhibit a Young's modulus sufficient to withstand the expected handling and use conditions. Young's modulus may be measured in accordance with one or more of the following ASTM procedures: D882; D5026-95a; D4065-89, each of which is incorporated herein in its entirety by reference. Any or all of the sheets may have a Young's modulus of at least about any of the following values: 100 MPa, 200 MPa, 300 MPa, and 400 MPa, measured at 100° C. The Young's modulus for the sheets may also range from about 70 to about 1000 MPa, and preferably range from about 100 to 500, measured at 100° C.

Any or all of the sheets may be oriented in either the machine (i.e., longitudinal) or the transverse direction, or in both directions (i.e., biaxially oriented), in order to reduce the permeability and to increase the strength and durability of the sheet. For example, the sheet may be oriented in at least one direction by a ratio of any of the following: at least 2.5:1, from about 2.7:1 to about 10:1, at least 2.8:1, at least 2.9:1, at least 3.0:1, at least 3.1:1, at least 3.2:1, at least 3.3:1, at least 3.4:1, at least 3.5:1, at least 3.6:1, and at least 3.7:1.

Any or all of the sheets may be heat shrinkable or non-heat shrinkable. If heat shrinkable, the sheets may have a total free shrink at 185° F. (85° C.) of at least about any of the following values: 5%, 10%, 15%, 40%, 50%, 55%, 60%, and 65%. The total free shrink at 185° F. (85° C.) may also be within any of the following ranges: from 40 to 150%, 50 to 140%, and 60 to 130%. The total free shrink is determined by summing the percent free shrink in the machine (longitudinal) direction with the percentage of free shrink in the transverse direction. For example, a sheet which exhibits 50% free shrink in the transverse direction and 40% free shrink in the machine direction has a total free shrink of 90%. It is not required that the sheet have shrinkage in both directions. The free shrink of the sheet is determined by measuring the percent dimensional change in a 10 cm×10 cm sheet specimen when subjected to selected heat (i.e., at a certain temperature exposure) according to ASTM D 2732, which is incorporated herein in its entirety by reference. The sheets may be annealed or heat-set to reduce the free shrink either slightly, substantially, or completely; however, a sheet may not be heat set or annealed once stretched if it is desired that the sheet have a high level of heat shrinkability.

In a preferred embodiment of the present invention the film is not heat-shrinkable. When, as in the package 11 liustrated in FIGS. 8 and 9, one or both of the base and lid sheets are at least partially thermoformed, preferably said thermoformable sheets are substantially non oriented and their thickness, before the thermoforming step, is preferably ≧2.5 mils, more preferably ≧3 mils.

One or more layers of any of the sheets used in the manufacture of the package of the present invention may include appropriate amounts of additives typically included to improve processability or performance of the thermoplastic materials, such as slip agents, antiblock agents, anti-oxidants, fillers, dyes, pigments, cross-linking enhancers, cross-linking inhibitors, radiation stabilisers, antistatic agents and the like agents.

In particular when the packaged product 16 is a food product, at least the top chamber sheet 18 (118) preferably incorporates or has dispersed in effective amounts of one or more antifog agents in the sheet resin before forming the resin into a sheet, and in the case of a multilayer sheet, in one or more of the layers of the sheet. The antifog agent may also be applied as an antifog coating to at least one surface of the sheet. Useful antifog agents and their effective amounts are well known in the art.

Any of the sheets, for example, the top chamber sheet 18 (118) and/or top frame sheet 26 (126), may be transparent to visible light to enable a consumer to see the packaged product in the areas where the sheet does not support a printed image (e.g., labeling information). "Transparent" as used herein means that the material transmits incident light with negligible scattering and little absorption, enabling objects (e.g., packaged product or print) to be seen clearly through the material under typical viewing conditions (i.e., the expected use conditions of the material). Also, any of the sheets may be opaque, colored, or pigmented. For example, the bottom chamber sheet 20 (120) and/or bottom frame sheet 28 (128) may be opaque, colored, or pigmented to provide a background for the packaged product 16 or to simulate the appearance of a conventional meat tray, or to hide the presence of an absorbing pad or of drip.

Useful films for forming the sheets may be selected from one or more of the films disclosed in International Patent Application Publication No. WO 01/68363 A1 published 20 Sep. 2001 entitled "Bi-Axially Oriented and Heat-Set Multilayer Thermoplastic Film for Packaging" and U.S. Pat. No. 6,299,984 issued 9 Oct. 2001 entitled "Heat-Shrinkable Multilayer Thermoplastic Film" (corresponding to EP 0 987 103 A1 published 22 Mar. 2000). Each of the foregoing publications is incorporated herein in its entirety by reference.

Another class of thermoplastic structures that proved useful for the manufacture of a package according to the present invention, particularly for the manufacture of a package as illustrated in FIG. 8 and in FIG. 9 wherein one or both of the base and lid sheets are thermoformed (or at least partially thermoformed), comprises laminates with an outer heat-sealing layer comprising an ethylene homo- or copolymer (e.g. LLDPE, VLDPE, homogeneous ethylene-α-olefin copolymers, LDPE, EVA, ionomers, etc.), a gas-barrier layer preferably comprising EVOH, and the other outer abuse resistant layer, comprising a polyamide, and preferably a polyamide with a melting point equal to or higher than 175° C. The thickness of this laminate, that can be obtained by heat- or glue-lamination of pre-formed layers or by coextrusion or extrusion coating, is generally comprised between 2 and 10 mils, preferably between 2.5 and 9 mils and more preferably between 3 and 8 mils. The structure typically comprises one or more inner bulk layers to reach the desired thickness, typically of low cost polyolefins, e.g. polyethylene and/or polypropylene resins. Tie layers, to improve the bond between the various layers and avoid delamination, might also be present, if needed or appropriate.

An example of a thermoplastic film structure of particular interest is the following nine layers structure with a total thickness of 150 microns (6 mils):

LLPDE1/LLDPE2/PP/PP/PP/PP/PP/EVOH/PA6 with the following partial thicknesses (μm) 13.5/30/6/21/15/21/6/15/22.5 wherein:

LLDPE1 is a linear low density polyethylene also containing slip and antiblock additives, used as the structure heat-sealable layer;

LLDPE2 is linear low density polyethylene;

PP is polypropylene;

EVOH is ethylene/vinyl alcohol copolymer; and

PA6 is Nylon 6, used as the outer abuse resistant layer.

In one embodiment the package 10 may be formed using packaging machine 74 (FIG. 5). Packaging machine 74 includes base unwind mandril 45 that supports base web roll 46 so that base web 40 may be fed to vacuum/gas-flush/sealing/inflation chamber 48 (i.e., "seal chamber 48"). Lid unwind mandril 51 supports lid web roll 50 so that lid web 38 may also be fed to seal chamber 48.

Figure 11:
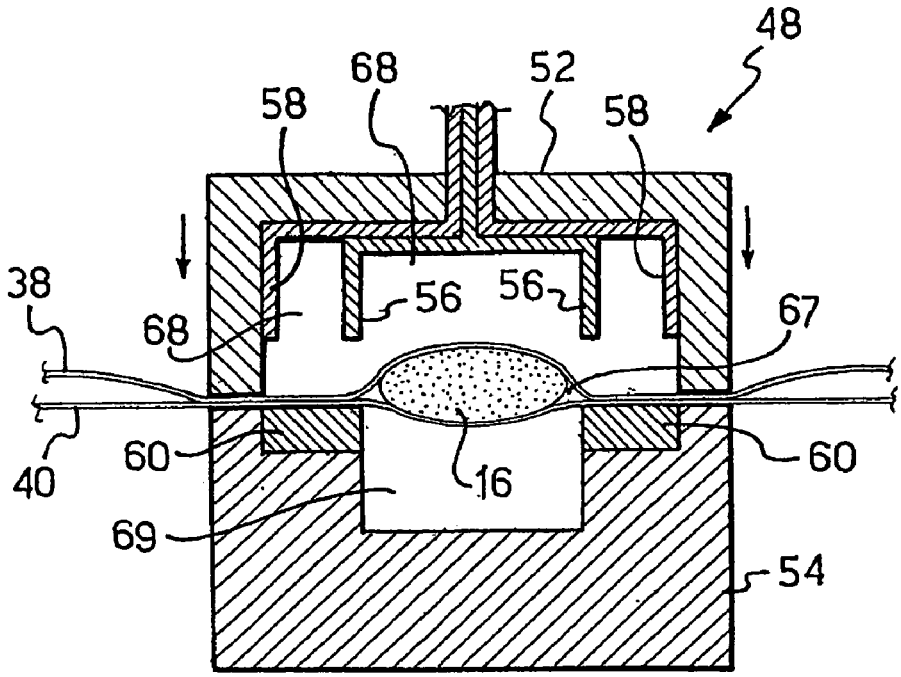
FIG. 11 is a representative sectional view of the vacuum/gas-flush/sealing/inflation chamber of FIG. 5 in the chamber close mode.
Figure 12:
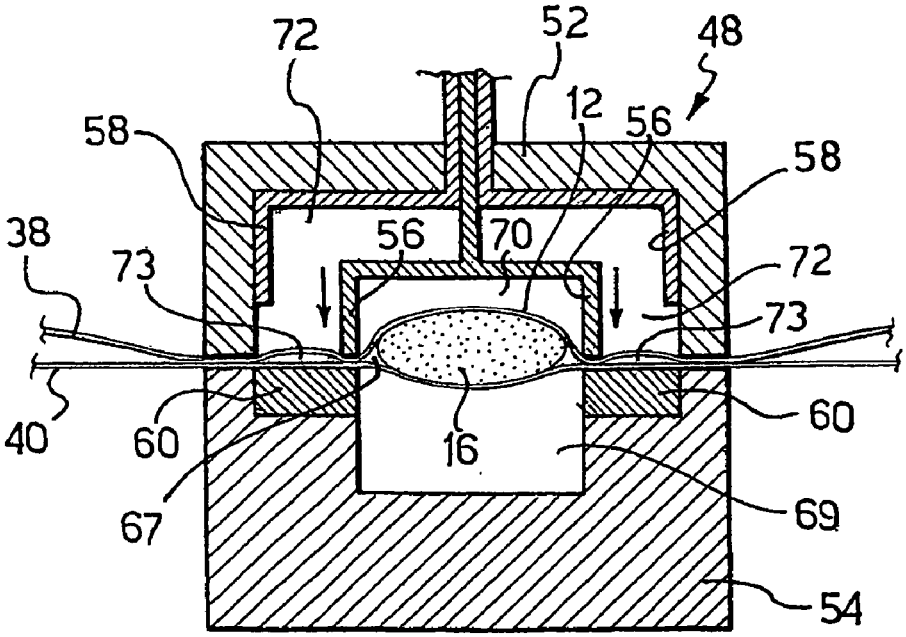
FIG. 12 is a representative sectional view of the vacuum/gas-flush/sealing/inflation chamber of FIG. 5 in the chamber portion seal mode.

Seal chamber 48 includes top chamber casing 52 and opposing bottom chamber casing 54. The top and bottom chamber casings are moveable relative each other to a chamber open mode, illustrated in FIGS. 10 and 14, and a chamber closed mode, illustrated in FIGS. 11, 12 and 13. In the chamber open mode, the top and bottom casings are spaced apart to allow the lid and base webs 38, 40 and product 16 to enter seal chamber 48. In the chamber closed mode, top and bottom casings 52, 54 are proximate each other to form an enclosed chamber volume 68.

Top chamber casing 52 may enclose and slideably receive both inner seal bar 56 and outer seal bar 58. Bottom chamber casing 54 may support seal anvil 60, which opposes both the inner and outer seal bars. Inner seal bar 56 and seal anvil 60 are moveable relative each other between an inner seal bar engaged position and an inner seal bar disengaged position. In the inner seal bar engaged position, illustrated in FIGS. 12 and 13, inner seal bar 56 and seal anvil 60 are proximate each other to define inner seal chamber volume 70 and outer seal chamber volume 72. In the inner seal bar disengaged position, illustrated in FIG. 11, the inner seal bar 56 and seal anvil 60 are spaced apart.

Similarly, outer seal bar 58 and seal anvil 60 are moveable relative each other between an outer seal bar engaged position and an outer seal bar disengaged position. In the outer seal bar engaged position, illustrated in FIG. 13, outer seal bar 58 and seal anvil 60 are proximate each other. In the outer seal bar disengaged position, illustrated in FIGS. 11 and 12, the outer seal bar 58 and seal anvil 60 are spaced apart.

Seal chamber 48 includes a vacuum source 62, a modified atmosphere source 64, and an inflation gas source 66, each of which is capable of controlled fluid communication with seal chamber 48, as discussed further below.

Cutter 76 is downstream from the seal chamber 48. Suitable cutters are well known in the art and include, for example, rotary cutters, knife cutters, cutting blades, and laser cutters.

In the operation of packaging machine 74, the base web 40 is unwound from base web roll 46 supported by base unwind mandril 45 and is fed to the seal chamber 48. The base web 40 may be pulled along by gripping chains (not shown) at two sides, as is known in the art. Product 16 may be placed on base web 40 before the web is fed to seal chamber 48. Lid web 38 is unwound from lid web roll 50 supported by lid unwind mandril 51 and is also fed to seal chamber 48. The lid web 38 may also be pulled along by gripping chains (not shown) at two sides, as is known in the art. At least a portion of lid web 38 may be positioned over product 16, either before or after product 16 enters seal chamber 48.

Figure 10:
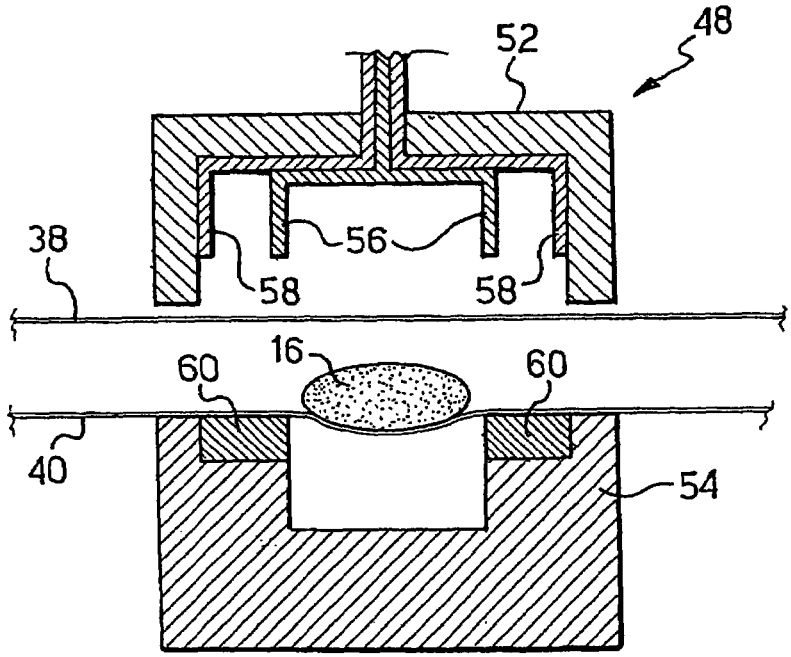
FIG. 10 is a representative sectional view of the vacuum/gas-flush/sealing/inflation chamber of FIG. 5 in the chamber open mode.

The lid and base webs 38, 40 on either side of product 16 are positioned between the top chamber casing 52 and bottom chamber casing 54 while the seal chamber 48 is in the chamber open mode (FIG. 10). Next, the seal chamber 48 moves to a chamber closed mode so that top and bottom chamber casings 52, 54 engage, compress, or squeeze the lid and base webs 38, 40 between them and as a result form three essentially airtight enclosed chamber volumes: upper chamber volume 68 (which is a volume above web 38), lower chamber volume 69 (which is a volume below web 40), and intermediate chamber volume 67 (which is a volume between webs 38 and 40 enclosing product 16). (FIG. 11) Optionally, upper and lower chamber volumes 68, 69 may be placed in fluid communication by appropriate piping, tubing, or other means, as is known in the art.

In the chamber closed mode (FIG. 11), a vacuum may be pulled on the enclosed intermediate chamber volume 67 to evacuate a desired amount of enclosed ambient air through vacuum source 62. Next, a modified atmosphere of a desired composition and amount may be introduced into intermediate chamber volume 67 through modified atmosphere source 64. The modified atmosphere may be introduced at a temperature lower than the ambient temperature, so that upon later warming to ambient temperature, the modified atmosphere within chamber portion 12 may obtain an above-ambient pressure.

It may be desirable to maintain a balanced force on the upper and lower webs (i.e., avoid ballooning of the intermediate chamber volume 67) when introducing modified atmosphere into intermediate chamber volume 67. To do so, the pressure in the upper and lower chamber volumes 68, 69 may be increased by introducing a gas (e.g., air or modified atmosphere) into those chamber volumes when introducing modified atmosphere into intermediate chamber volume 67.

Subsequently, inner seal bar 56 and seal anvil 60 move to the inner seal bar engaged position (FIG. 12) to compress lid and base webs 38, 40 between them and also to define inner seal chamber volume 70, outer seal chamber volume 72, and frame volume 73 (between the lid and base webs). The inner seal bar is heated to a temperature effective to heat seal the webs together in chamber seal zone 22 (see FIG. 2). In so doing, chamber portion 12 is formed enclosing modified atmosphere 24 and product 16 (see FIG. 2).

Next, an inflation gas is introduced into the frame volume 73 through inflation gas source 66. Suitable inflation gas includes, for example, air, nitrogen, or modified atmosphere (including modified atmosphere having the same composition as that introduced through modified atmosphere source 64, as discussed above). An amount of inflation gas is added to elevate the pressure within frame volume 73 to a desired amount, for example, a gauge pressure (wherein "gauge pressure" is the pressure difference between the system and the atmospheric pressure) of at least about any of the following values: 0.1, 0.2, 0.3, 0.4, 0.5, 0.6, 0.8, and 1 bar; a gauge pressure of less than about 2 bar; and a gauge pressure ranging between any of the foregoing values (e.g., from about 0.2 bar to about 0.8 bar, and from about 0.3 bar to about 2 bar).

It may also be desirable to maintain a balanced force on the upper and lower webs (i.e., avoid premature ballooning of the frame volume 73) when introducing inflation gas into frame volume 73. To do so, the pressure in the outer seal chamber volume 72 may be increased by introducing an inflation gas into that chamber volume when introducing inflation gas into frame volume 73.

Figure 13:
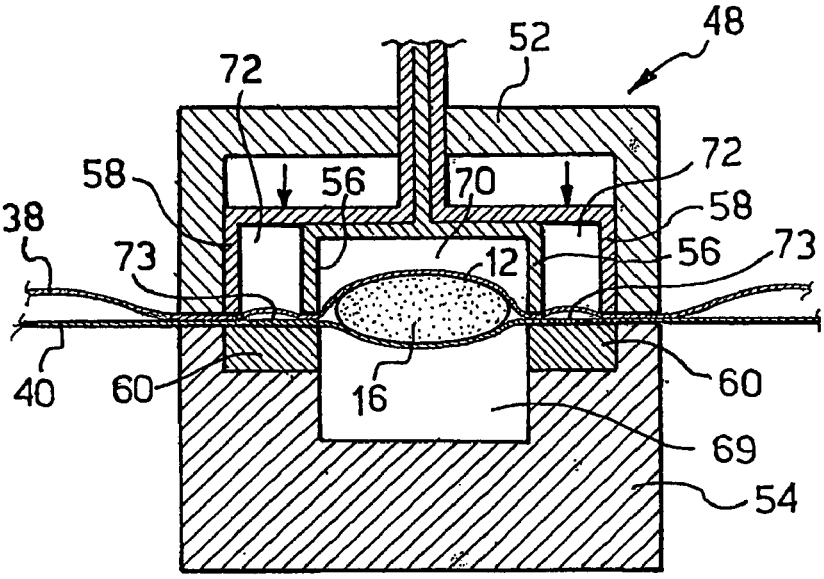
FIG. 13 is a representative sectional view of the vacuum/gas-flush/sealing/inflation chamber of FIG. 5 in the frame seal mode.

Turning to FIG. 13, outer seal bar 58 and seal anvil 60 move to the outer seal bar engaged position (FIG. 13) to compress lid and base webs 38, 40 between them. The outer seal bar is heated to a temperature effective to heat seal the webs together in frame outer seal zone 32 (see FIG. 2). In so doing, hollow frame 14 is formed enclosing the inflation gas at the elevated pressure.

Figure 14:
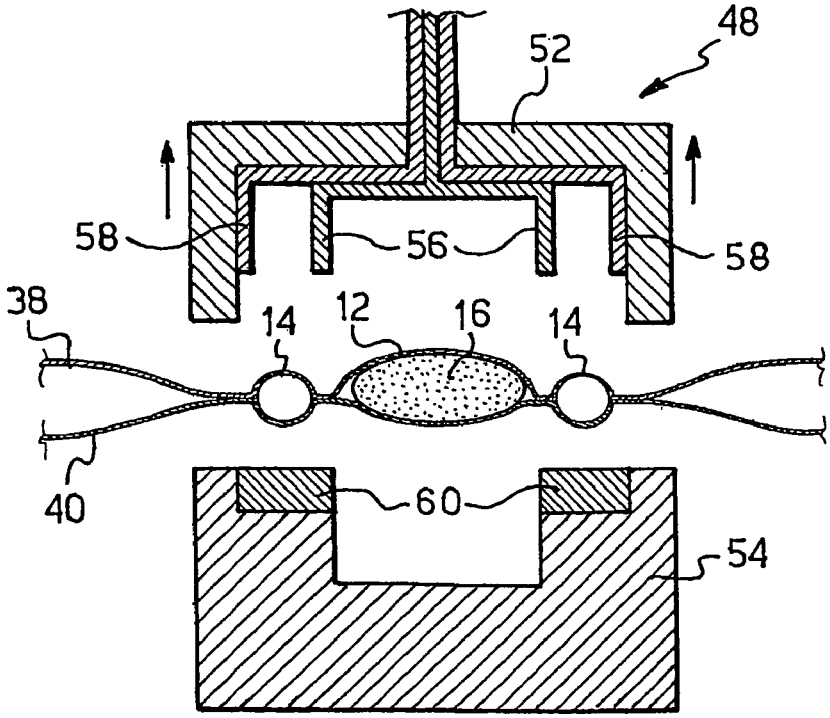
FIG. 14 is a representative sectional view of the vacuum/gas-flush/sealing/inflation chamber of FIG. 5 in the chamber open mode with a formed package of the present invention.

Next, the inner and outer seal chamber volumes 70, 72 and lower chamber volume 69 may be vented to restore ambient pressure before opening the chamber. Then, the top and bottom chamber casings return to the chamber open mode, with inner seal bar 56 and seal anvil 60 in the disengaged position and outer seal bar 58 and seal anvil 60 in the disengaged position, as illustrated in FIG. 14.

Upon exposure to ambient pressure, frame 14 takes on an inflated condition since the pressure within frame 14 is greater than the ambient pressure. In taking on an inflated condition, frame 14 tries to pull away from chamber portion 12, thus creating a tension that provides some stiffness or rigidity to the package 10 and to chamber portion 12 (containing the modified atmosphere) relative to the state where frame 14 is not inflated. The pressure within frame 14 may be any of the pressures mentioned above with respect to the pressure within outer seal chamber volume 72.

Lid and base webs may be indexed forward so that cutter 76 (FIG. 5) may sever the webs to release package 10. The cutter may cut the webs, for example, by butt or die cuts as is known in the art. Although the cutter 76 is illustrated in FIG. 5 as downstream from seal chamber 48, the cutter may alternatively be located just upstream of the seal chamber 48. The packaging machine 74 may operate in an indexed and/or essentially continuous manner, to produce numerous packages 10 from the lid and base web rolls.

Figure 15:
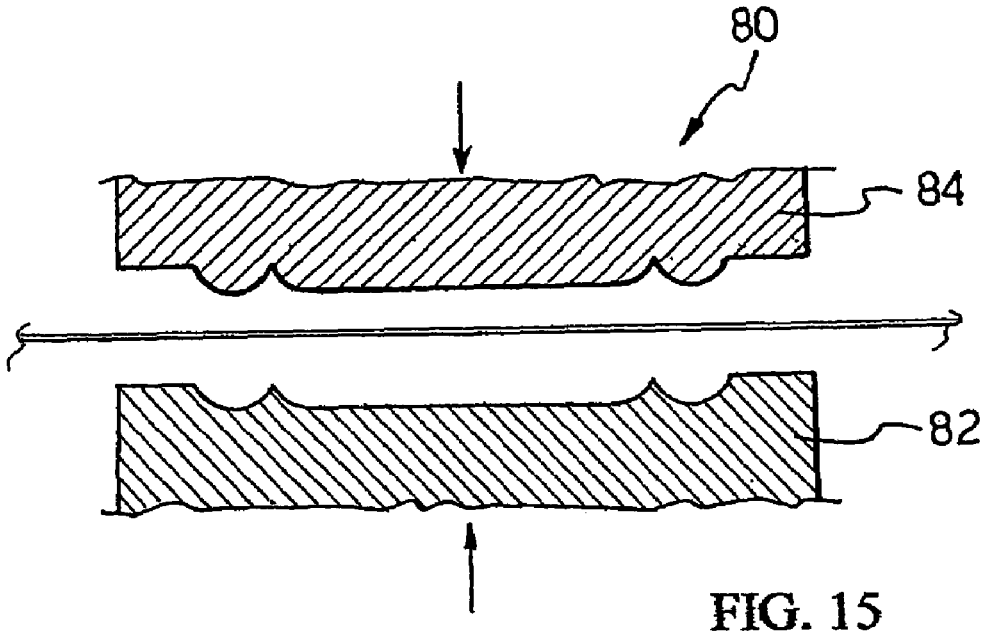
FIG. 15 is a representative sectional view of a thermoforming station.
Figure 16:
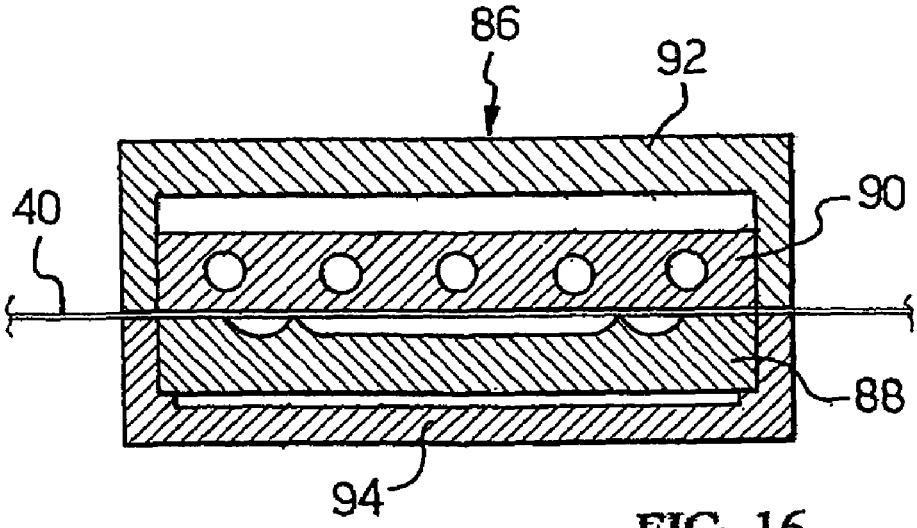
FIG. 16 is a representative sectional view of another thermoforming station.

The manufacture of a package 11 wherein either one or both of the lid and base sheets are thermoformed, as illustrated in FIGS. 8 and 9, involves the use of at least one thermoforming station to thermoform a portion of the base web 40 upstream from the point where product 16 is placed on the web and/or of the lid web 30 upstream the vacuum chamber 48. Thermoforming stations and thermoforming methods are well known in the art, and include positive or negative vacuum forming and positive or negative compressed air forming, any of which may be used with or without mechanical pre-stretching and with or without plug assist. For example, the packaging machine illustrated in FIG. 5 may be modified to include a thermoforming station, such as that represented by thermoform station 80 (FIG. 15) having mold 82 and opposing plug 84, which cooperate to form base web into a desired shape, such as the shape of the thermoformed base sheet 136 (which in FIG. 8 includes thermoformed bottom chamber sheet 120 and thermoformed bottom frame sheet 128). Another example of a suitable thermoforming station is represented by thermoforming station 86 (FIG. 16) having forming mold 88, opposing hot plate 90, and enclosing top and lower chambers 92, 94. Thermoforming station 86 may also be used to form base web into a desired shape, such as the shape of the thermoformed base sheet 136 (FIG. 8). Base web 40 may be formed into a series of tray shapes having flanges to facilitate the sealing of the lid web 38 to the base web 40. The bottom frame sheet may or may not be thermoformed. Alternatively, only the frame sheets, bottom and/or top frame sheets, may be thermoformed while the chamber sheets are not.

Figure 17:
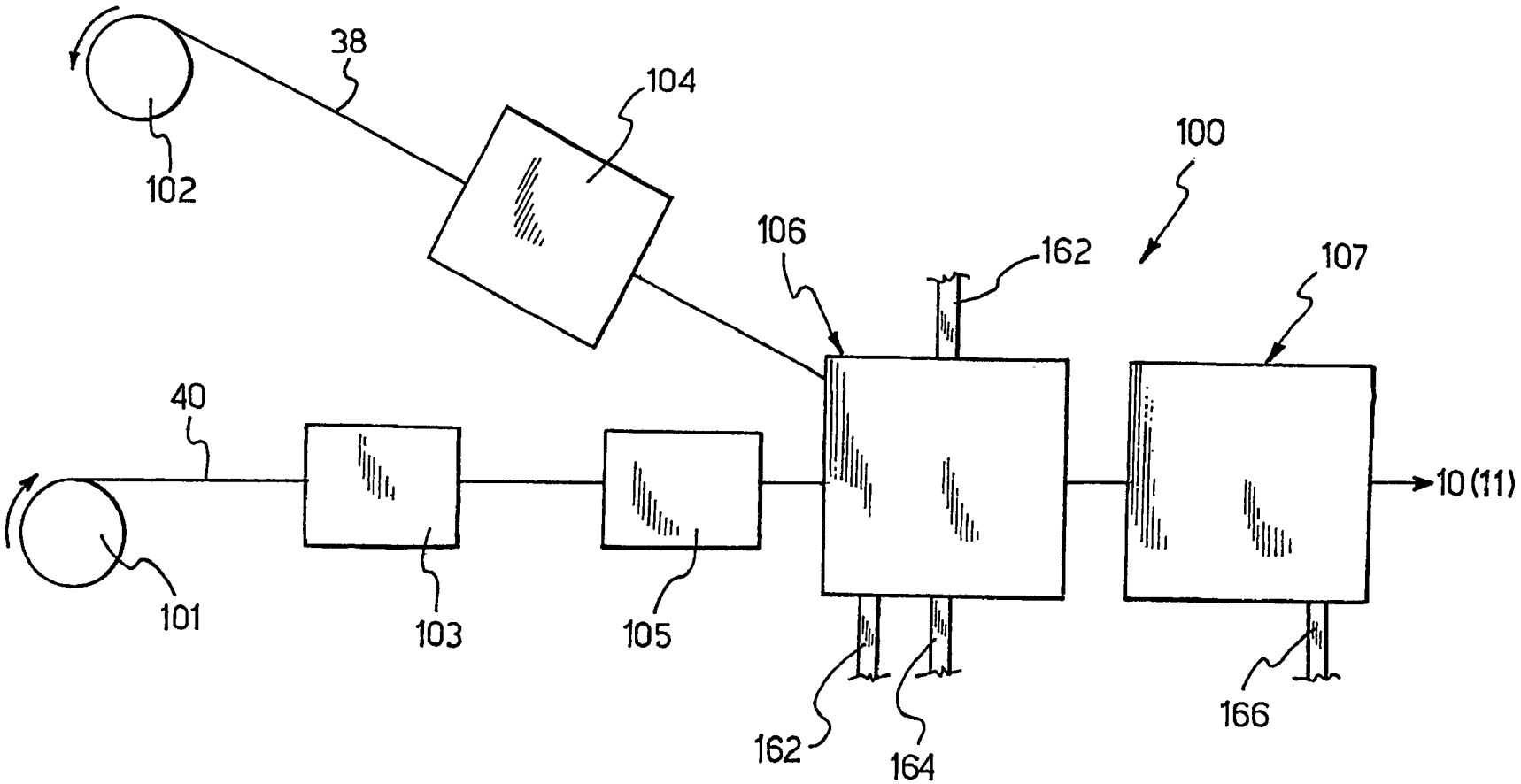
FIG. 17 is a representative schematic of an alternative process line for making a package of the present invention.

In another, preferred, embodiment, package 10 (11) may be formed using the packaging machine schematically represented in FIG. 17 and indicated as 100.

In said Figure, 101 is the unwinding station for the base web roll, while 102 is the unwinding station for the lid web roll. 103 and 104 identify two separate thermoforming stations that can be excluded, if neither the base or the lid have to be thermoformed, or can be separately and independently actuated to provide for only the base web 40, or only the lid web 38 or both base and lid webs at least partially thermoformed.

Figure 18:
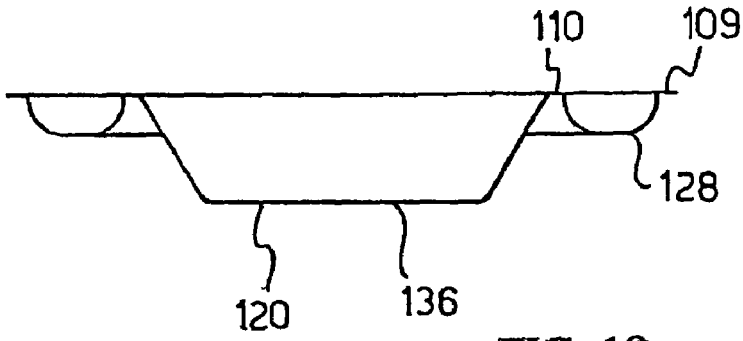
FIG. 18 is a representative sectional view of a preferred thermoformed base sheet suitable for the manufacture of a package of the present invention.

When at least one of the base and lid webs is thermoformed, a preferred profile of thermoforming is that indicated in FIG. 18 for a base web. In said FIG. 18, 136 is the overall thermoformed base sheet, 128 is the thermoformed bottom frame sheet, 109 is the outermost edge of the thermoformed bottom frame sheet 128, 120 is the thermoformed bottom chamber sheet, and 110 is the edge separating the thermoformed bottom frame sheet 128 from the thermoformed bottom chamber sheet 120. In said FIG. 18, 120, 128, and 136 correspond to the items identified with the same numerals in package 11 of FIGS. 8 and 9, and 109 and 110 correspond to the same numerals in the plan view of the thermoformed web of FIG. 19.

105 is the station where product 16 is suitably positioned on the base web. When the base web 40 is thermoformed e.g. as in the embodiment of FIG. 18, product 16 is loaded into the thermoformed bottom chamber sheet.

The base web 40 loaded with product 16 and the corresponding lid web 38, are then advanced to a vacuum/gas-flushing/sealing chamber schematically indicated by the numeral 106 ("first chamber"). Said first chamber 106 differs from chamber 48 described above essentially in that it does not include an inflation gas source.

In said first chamber 106, if desired, it is possible to draw vacuum within chamber portion 12, through a vacuum source 162, and optionally introduce therein a suitably modified atmosphere 24, through a modified atmosphere source 164. Then moving the seal bars and the seal anvils into the engaged position, either in one single or two separate steps, all the seals of the end package 10 (11), i.e. the frame outer seal 32, the frame inner seal 30 and the chamber portion seal 22, are made. The thus obtained intermediate package, where product 16 is sealed within chamber portion 12, either under vacuum or under the desired, optionally modified, atmosphere, and frame portion 14 is sealed but not yet inflated, is then passed to a second severing/inflating chamber 107 ("second chamber"). In said second chamber 107, the webs are severed by suitable cutters, to separate the individual intermediate package, and then frame portion 14 is inflated by blowing the desired gas therein through a hole 108 which may be located either in the top frame sheet 26 (126) or in the bottom frame sheet 28 (128). Once frame portion 14 is inflated, hole 108 is closed or anyway separated from the inflated frame portion 14, e.g. by heat-sealing, before the final package leaves said second chamber 107.

Hole 108 is preferably created in one of the thermoforming stations 103 and 104, in the loading station 105, or in a separate dedicated station that can be positioned between the thermoforming and the product loading stations.

Figure 19:
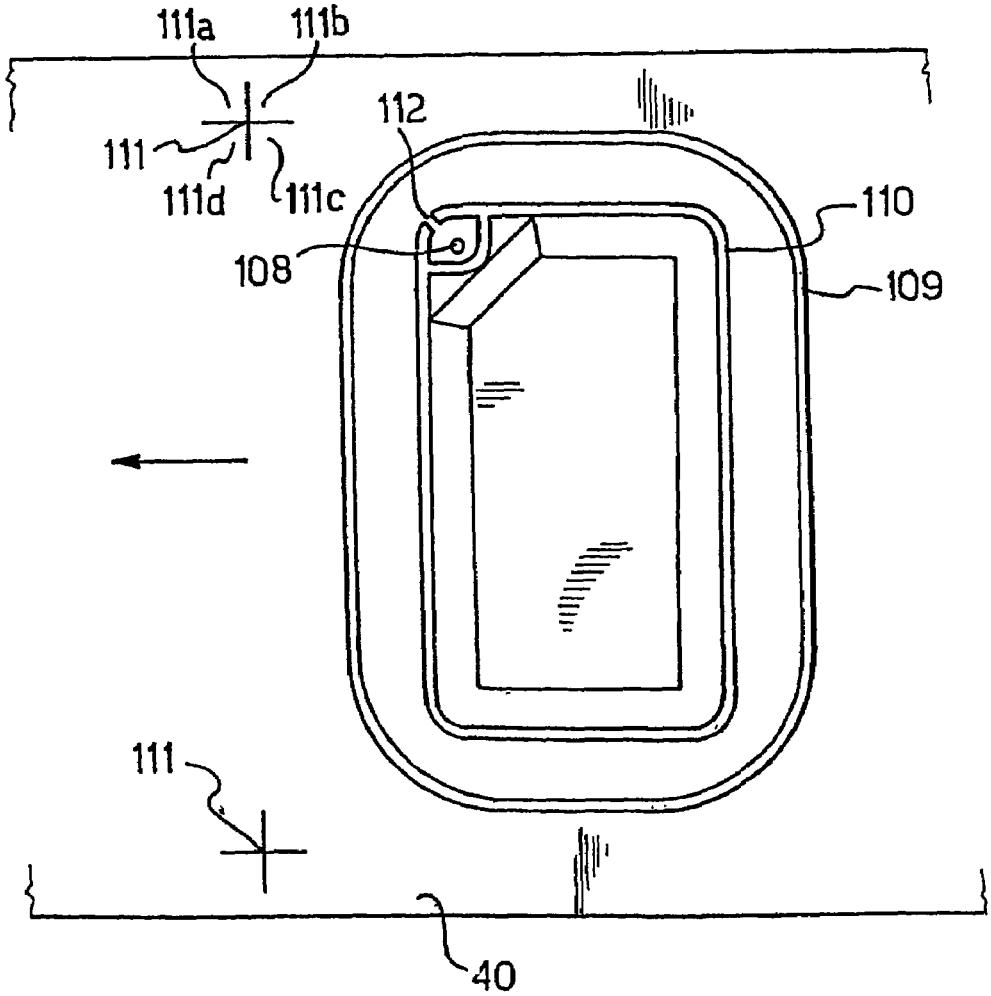
FIG. 19 is a plan view of a base web thermoformed as illustrated in FIG. 18.

FIG. 19 represents a plan view of a suitably thermoformed base web entering the loading station 105. In said FIG. 19, 108 is the hole that will be used to inflate frame portion 14 in severing/inflating chamber 107, and the double lines 109 and 110 are the edges of the thermoformed portions (the correspondence with the profile of FIG. 18 is indicated by using the same numerals). The web also contains slits 111, cut through the web, which are used for the optional steps of vacuumization and introduction of the modified atmosphere 24. Preferably said slits 111 are cut through the web with the shape of a cross as illustrated in FIG. 19. The base web 40 loaded with product 16 is advanced to first chamber 106 where it is positioned so that slits 111 are immediately over a matrix containing orefices which are connected through a pipe positioned below the slits, to the source of vacuum 162. Once the first vacuum chamber 106 is closed, clamping the base and lid webs inside, vacuum may be applied through said pipe and the edges of the slits 111, indicated in FIG. 19 as 111*a*, 111*b*, 111*c*, and 111*d*, are drawn down against the interior side of the pipe so as to enlarge the passage for the air. To prevent collapse of the lid web 38 over the base one 40, due to the vacuumization of the space between the two, vacuum is drawn also from the top of the vacuum chamber to keep the lid web raised over the base web 40. This can be done using a different or, as schematically illustrated in FIG. 17, the same vacuum source 162. After the drawing of vacuum, the desired modified atmosphere 24 is injected into the first chamber 106 through the same slits 111, by excluding the vacuum source 162 and actuating the modified atmosphere source 164. Once the pressure of the gas forced upwardly through the slits 111 into the vacuum chamber has reached the desired value, the sealing mechanism within the chamber is arranged to seal the packages individually along closed lines of seal 32, 30, and 22, between the base web 40 and the lid web 38, excluding the slits 111 and leaving hole 108 within the frame portion 14. With reference to FIG. 19, preferably said closed lines will correspond to the double lines 109 and 110.

The first chamber 106 is then opened and the sealed webs are advanced to the second chamber 107, where suitable cutters sever the sealed webs to release the individual package. Air or any other desired gas is then blown into the frame portion 14 through a suitable nozzle, into register with the hole 108, connected to an inflation gas source 166. To keep hole 108 in correspondence with the nozzle, a hollow pressing device may suitably be employed. With reference to the particular embodiment illustrated in FIG. 19, where hole 108 communicates with frame portion 14 through a passage 112, this in fact should be achieved without compressing the unsealed passage 112 that needs to be free to allow inflation of frame portion 14.

Alternatively a small and flexible tube, still connected to the inflation gas source 166, can be inserted into hole 108, and used to inflate frame portion 14. When a small tube is employed, it is also possible to connect it to a suitable pump and reservoir and inflate, and thus stiffen, frame portion 14 with any fluid, including liquids, such as water and aqueous solutions, and flowable powders.

As soon as frame portion 14 is inflated as desired, hole 108 is closed and/or the communication between hole 108 and frame portion 14 is closed, while the package is still in severing/inflating chamber 107. This can be achieved by any means, such as for instance by applying a barrier label on top of the hole, by heat-sealing together the top sheet to the bottom sheet of the package in an area that includes at least the hole 108 and is larger than the hole, or by means of a closed seal line around the hole to eliminate any communication between hole 108 and frame portion 14. With reference to FIG. 19, preferably hole 108 may be closed either by heat-sealing the passage 112 or by heat-sealing the top sheet to the bottom sheet in the whole area around hole 108 which is delimited in said Figure by the double lines and by the passage 112.

In the embodiment illustrated in FIG. 7, modified atmosphere 24 is introduced into chamber 12 by the chamber inflation passageway 44, which is sealed or otherwise closed afterwards. The frame 14 is inflated by introducing an inflation gas or the desired fluid through frame inflation passageway 42, which is sealed or otherwise closed afterwards.

An end user may open package 10 (11), for example, by cutting top chamber sheet 18 (118) to provide access to product 16. After removal of product 16, the inflated frame 14 may be punctured to deflate it or the passageway 42, if any, may be opened. The deflated package 10 (11) may then be ready for recycling.

The new package according to the present invention may however be fitted with easy opening features that may help the end user to open the package, and particularly the chamber portion 12 without resorting to the use of cutting or puncturing tools.

Figure 20B:
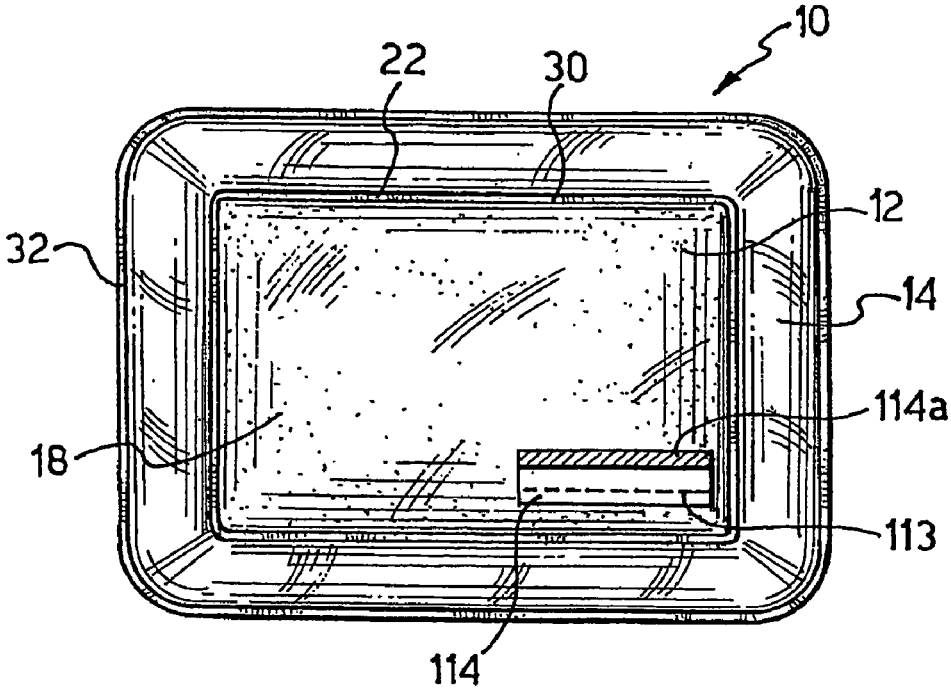
FIGS. 20*a*, 20*b*, and 20*c*, are plan views of packages of the present invention equipped with different easy-opening features.
Figure 20A:
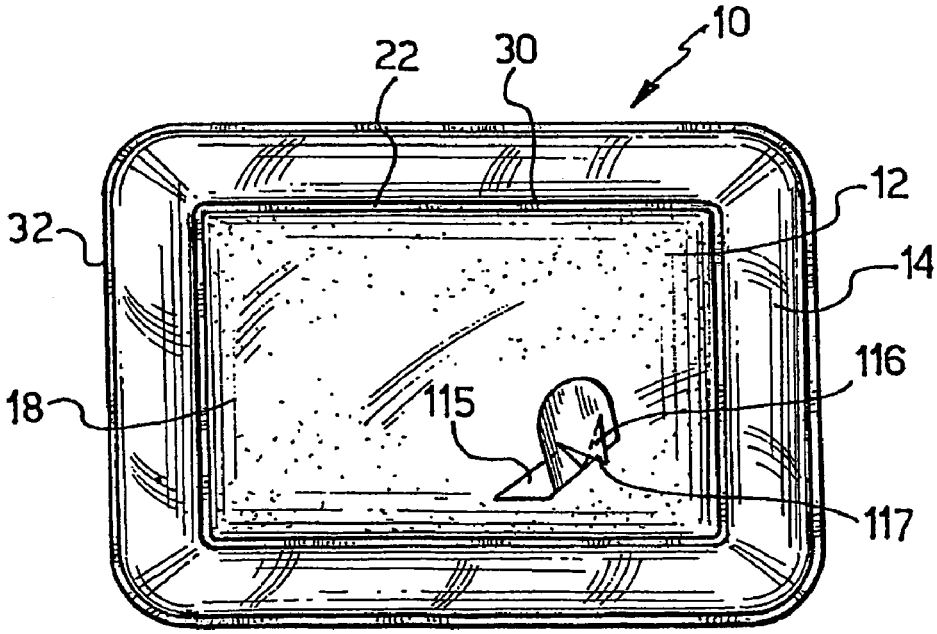

Examples of easy opening features applied to the new package are illustrated in FIGS. 20*a, b*, and *c*.

As illustrated in FIG. 20*a*, the bottom chamber sheet 20 (120) or, preferably, the top chamber sheet 18 (118), may present a weakness line 113, that may be e.g., a through cut, either continuous or discontinuous, or a line where the thickness of the web has been reduced so that a slight pressure may break the film, covered by an adhesive label 114 that has a non adhesive tab (114*a*) integral thereto so that it can be easily peeled off, when desired, by grasping said non adhesive tab with the fingers, peeling it off and thus leaving the weakness line exposed.

Alternatively, as illustrated in FIG. 20*b*, the top chamber sheet 18 (118) has secured to its outer surface a tab 115 made of resilient material comprising lines of weakening 116 defining a cutter 117 capable of piercing the top chamber sheet 18 (118) when pressed against it. To open the package, the tab is raised, the lines of weakening 116 are bent, broken or torn by the user to expose the cutting edge of the cutter 117 which is then pressed against the top chamber sheet to pierce it. Also in this case the easy opening feature can alternatively be positioned on the bottom chamber sheet 20 (120) even if it is clearly more visible to the user if positioned on the top chamber sheet.

Figure 20C:
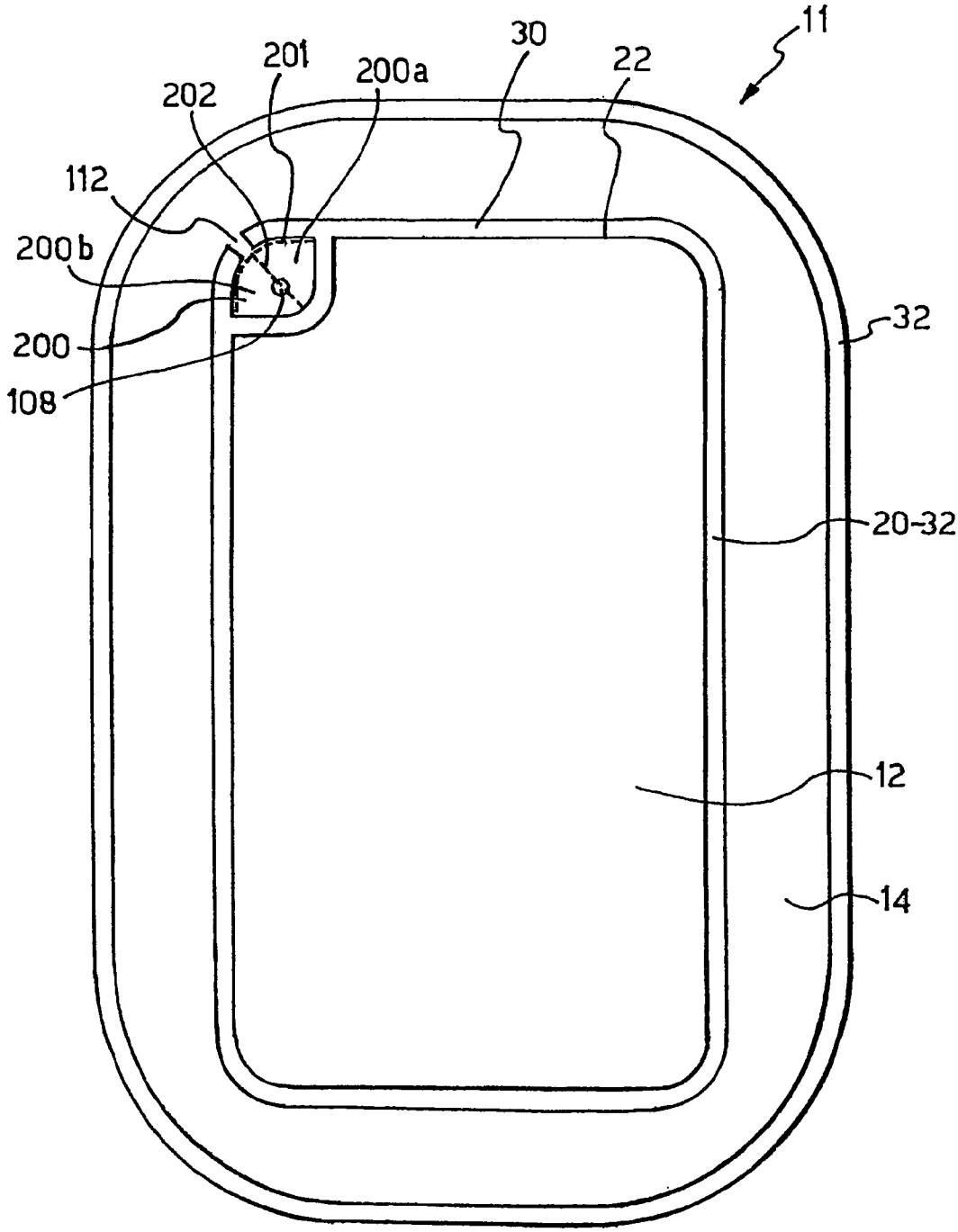

In FIG. 20*c* it is illustrated a preferred embodiment of the invention where a tear-open slit, either in the form of a continuous or discontinuous cut, is created in an area of the juxtaposed lid and base sheets, isolated from frame portion 14 and adjacent to the chamber seal zone 22, said slit being almost perpendicular to the chamber seal 22. The package illustrated in said Figure may conveniently be obtained using the packaging machine 100 of FIG. 17 and the process illustrated above, where frame portion 14 is inflated through a hole 108 and the communication between frame portion 14 and hole 108 is then excluded by either heat-sealing the passage 112 or by heat-sealing together the lid and base sheets over the whole area around said hole which is delimited by the double lines and by the passage 112. Said area is identified in FIG. 20*c* with numeral 200. Along the border of area 200 which are in contact with the frame inner seal zone 30 there is a serration 201 and area 200 is divided in two parts by a second serration 202 almost perpendicular to the chamber seal zone 22. By pressing on this area it is thus possible to break the serrations 201 and 202 and pulling apart the two flaps thus created, 200*a* and 200*b*, easily open chamber portion 12. Alternatively, instead of serration lines it is possible to foresee cuts through the top and bottom webs.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. All references to ASTM tests are to the most recent, currently approved, and published version of the ASTM test identified, as of the priority filing date of this application. Each such published ASTM test method is incorporated herein in its entirety by this reference.

The invention claimed is:

1. A package for containing a product, the package comprising:

top and bottom opposing flexible chamber sheets sealed together in a selected chamber seal zone to define a watertight chamber portion that is capable of containing the product; and a hollow frame circumscribing the chamber portion and adapted to support the chamber portion when the frame is inflated.

2. The package of claim 1 wherein:

the frame comprises top and bottom opposing flexible frame sheets sealed together at a selected frame outer seal zone proximate the perimeter of the frame and at a selected frame inner seal zone proximate the chamber portion; and the outer seal zone of the frame is spaced apart from the chamber seal zone defining the chamber portion.

3. The package of claim 2 wherein:

a lid sheet comprises both the top frame sheet and the top chamber sheet;

a base sheet comprises both the bottom frame sheet and the bottom chamber sheet; and the lid and base sheets extend continuously from the frame to the chamber portion.

4. The package of claim 2 wherein:

a lid sheet comprises both the top frame sheet and the top chamber sheet, wherein the lid sheet is formed from a lid web; and a base sheet comprises both the bottom frame sheet and the bottom chamber sheet, wherein the base sheet is formed from a base web.

5. The package of claim 3 wherein:

the lid sheet is sealed to the base sheet at both the frame outer seal zone and the frame inner seal zone; and the frame inner seal zone is coextensive with the chamber seal zone.

6. The package of claim 2 wherein the top and bottom frame sheets are heat sealed together at the frame outer seal zone.

7. The package of claim 2 wherein the top and bottom frame sheets are adhesively sealed together at the frame outer seal zone.

8. The package of claim 3 comprising a weakness line continuously extending between the frame inner seal zone and the chamber seal zone to allow detachability of the chamber portion from the frame.

9. The package of claim 2 further comprising a tear-open slit, in the form of a continuous or discontinuous cut, created in an area of the juxtaposed lid and base sheets, isolated from the frame portion and adjacent to the chamber seal zone, said slit being almost perpendicular to the chamber seal.

10. The package of claim 1 wherein the bottom chamber sheet is opaque.

11. The package of claim 1 wherein the top and bottom chamber sheets each comprise one or more thermoplastic polymer materials.

12. The package of claim 1 wherein the top and bottom chamber sheets each have an oxygen transmission rate of less than about 150 cubic centimeters (at standard temperature and pressure) per square meter per day per 1 atmosphere of oxygen pressure differential measured at 0% relative humidity and 23° C.

13. The package of claim 1 wherein the top and bottom frame sheets each have an oxygen transmission rate of less than about 150 cubic centimeters (at standard temperature and pressure) per square meter per day per 1 atmosphere of oxygen pressure differential measured at 0% relative humidity and 23° C.

14. The package of claim 1 further comprising a frame inflation passageway for inflating the frame.

15. The package of claim 14 wherein the frame inflation passageway comprises a one-way valve.

16. The package of claim 1 further comprising a chamber inflation passageway for introducing a modified atmosphere into the chamber portion.

17. The package of claim 1 further comprising a modified atmosphere in the chamber portion.

18. The package of claim 1 wherein the frame is inflated to a pressure above ambient pressure.

19. The package of claim 1 wherein the frame is inflated to a gauge pressure of at least about 0.2 bar.

20. A packaged product comprising:

the package of claim 1; and a product within the chamber portion.

21. The packaged product of claim 20 wherein the product is a food.

22. The packaged product of claim 20 wherein the product is a meat.

23. A process of packaging comprising:

providing a base web comprising a flexible sheet material;

placing a product on the base web;

positioning over the product a lid web comprising a flexible sheet material;

sealing the lid web to the base web at a selected chamber seal zone to form a watertight chamber portion enclosing the product; and sealing the lid web to the base web at one or more selected frame seal zones to form a hollow frame circumscribing the chamber portion and adapted to support the chamber portion when the frame is inflated.

24. The process of claim 23 further comprising folding at least a portion of the base web over the product to form the lid web.

25. The process of claim 23 wherein at least one of the selected frame seal zones is coextensive with the selected chamber seal zone.

26. The process of claim 23 wherein the sealing of the lid web to the base web at the selected chamber seal zone forms a chamber portion enclosing a modified atmosphere within the chamber portion.

27. The process of claim 23 wherein the sealing of the lid web to the base web at one or more selected frame seal zones forms the hollow frame enclosing gas at a pressure above ambient pressure.

28. The process of claim 23 further comprising introducing a modified atmosphere into the chamber portion.

29. The process of claim 23 further comprising inflating the hollow frame.

30. The process of claim 23 further comprising thermoforming at least a portion of the base web into a desired configuration before placing the product on the base web.

31. The process of claim 23 further comprising thermoforming at least a portion of the lid web into a desired configuration before positioning it over the product.

32. The process of claim 23 further comprising severing the base web to form a package base web portion and a remaining base web portion, wherein:

the hollow frame comprises the package base web portion; and the remaining base web portion is outside of the package base web portion.

33. The process of claim 23 further comprising severing the lid web to form a package lid web portion and a remaining lid web portion, wherein:

the hollow frame comprises the package lid web portion; and the remaining lid web portion is outside of the package lid web portion.

34. The process of claim 23 wherein the sealing to form the chamber portion and the sealing to form the frame are performed simultaneously.

35. The process of claim 23 wherein the sealing to form the chamber portion occurs before the sealing to form the circumscribing frame.

36. The process of claim 23 wherein the step of sealing the lid web to the base web to form the chamber portion encloses the product in a vacuum.

* * * * *